US006642772B2

(12) United States Patent
Takai et al.

(10) Patent No.: US 6,642,772 B2
(45) Date of Patent: Nov. 4, 2003

(54) FUNCTION CIRCUIT THAT IS LESS PRONE TO BE AFFECTED BY TEMPERATURE

(75) Inventors: Daisuke Takai, Kanagawa-ken (JP); Kazuo Hasegawa, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/272,591

(22) Filed: Oct. 15, 2002

(65) Prior Publication Data

US 2003/0076151 A1 Apr. 24, 2003

(30) Foreign Application Priority Data

Oct. 23, 2001 (JP) ..... 2001-324765

(51) Int. Cl.[7] ..... H03K 17/60
(52) U.S. Cl. ..... 327/478; 327/484; 327/490
(58) Field of Search ..... 327/478, 482, 327/484–492; 323/315

(56) References Cited

U.S. PATENT DOCUMENTS 4,223,280 A * 9/1980 Ahmed ..... 327/439
4,730,124 A * 3/1988 Metz ..... 327/484
5,793,247 A * 8/1998 McClure ..... 327/538
6,433,624 B1 * 8/2002 Grossnickle et al. ..... 327/543

FOREIGN PATENT DOCUMENTS

JP 8-202463 8/1996

* cited by examiner

*Primary Examiner*—Toan Tran
(74) *Attorney, Agent, or Firm*—Beyer Weaver & Thomas

(57) ABSTRACT

Current mirror circuits that are parts of a first circuit and a second circuit, respectively, allow the same constant current to flow through the input side and the output side. Therefore, the base-emitter voltages of transistors Tr1 and Tr4, which tend to vary due to a temperature variation, can be set identical and hence can cancel out each other sufficiently. The same is true of the base-emitter voltages of transistors Tr5 and Tr8. Therefore, an input signal can be converted by a function having reference voltages as change points without being affected by temperature. Desired function circuits can be obtained by combining first circuits and second circuits in various manners.

3 Claims, 8 Drawing Sheets

FUNCTION CIRCUIT THAT IS LESS PRONE TO BE AFFECTED BY TEMPERATURE

BACKGROUND OF THE INVENTION

1. Field of the Invention

The present invention relates to a function circuit for converting an input signal into an output signal by a prescribed function. In particular, the invention relates to a function circuit that is less prone to be affected by temperature.

2. Description of the Related Art

FIG. 5 is a circuit diagram of a conventional function circuit. FIG. 6 shows an input/output characteristic of the circuit of FIG. 5.

The function circuit of FIG. 5 is composed of three resistors R1, R2, and R3, two diodes D1 and D2, and two reference supply voltages V1 and V2. As shown in FIG. 5, the resistor R2, the diode D1, and the reference supply voltage V2 are connected to each other in series and the resistor R3, the diode D2, and the reference supply voltage V1 are also connected to each other in series. The resistor R1 is connected to the resistors R2 and R3. One end of the resistor R1 is an input terminal IN and the other end (connecting point) is an output terminal OUT of the function circuit. The diode D2 is opposite in direction to the diode D1. An input signal Vs is input to the input terminal IN. For example, the reference supply voltage V1 is 2 V and the reference supply voltage V2 is 3 V.

In the input/output characteristic shown in FIG. 6, the horizontal axis represents the input signal Vs that is input to the input terminal IN and the vertical axis represents the output signal Vout at the output terminal OUT of the function circuit. In FIG. 6, each of Vs and Vout is in the range of 0 V to 5 V. As shown in FIG. 6, as the voltage level of the input signal Vs increases gradually, two change points α and β where linear lines having different slopes are connected to each other smoothly appear in the vicinity of the voltages 2 V and 3 V (reference supply voltages V1 and V2), respectively. A generally S-shaped curve can be formed that is bent at the change points α and β that are in the vicinity of 2 V and 3 V.

The output signal Vout shown in FIG. 5 can be given by the following formulae, where Vd is the forward voltage of the diodes D1 and D2:

When Vs≧V1+Vd (in the vicinity of the high-temperature-side change point), $$Vout=\{R2/(R1+R2)\}(Vs-V1-Vd)+V1+Vd. \quad (1)$$

When Vs≦V2−Vd (in the vicinity of the low-temperature-side change point), $$Vout=\{R1/(R1+R3)\}(V2-Vd-Vs)+Vs \quad (2)$$

When V1<Vs<V2, $$Vout=Vs \quad (3)$$

because the output resistance of the function circuit is rendered in a high-impedance state.

FIG. 7 is a circuit diagram of another conventional function circuit. FIG. 8 shows an input/output characteristic of the function circuit of FIG. 7.

The function circuit of FIG. 7 is mainly composed of a first circuit including an npn transistor Q1 and a pnp transistor Q2 and a second circuit including a pnp transistor Q3 and an npn transistor Q4. In the first circuit, the base terminal of the transistor Q1 and the emitter terminal of the transistor Q2 are connected to each other. In the second circuit, the base terminal of the transistor Q3 and the emitter terminal of the transistor Q4 are connected to each other. The emitter terminal of the transistor Q1 and the emitter terminal of the transistor Q3 are connected to each other via resistors R2 and R3 that have the same resistance (R2=R3). One end of a resistor R1 is connected to the connecting point P1 of the resistors R2 and R3. The other end of the resistor R1 serves as an input terminal IN to which an input signal Vs is input. A reference supply voltage V1 (2 V) is applied to the base terminal of the transistor Q2, and a reference supply voltage V2 (3 V) is applied to the base terminal of the transistor Q4. The connecting point P1 also serves as an output terminal OUT.

In the second function circuit of FIG. 7, the potential of the emitter terminal of the transistor Q2, that is, the base potential of the transistor Q1, is set higher than the reference supply voltage V1 (2 V) that is applied to the base terminal of the transistor Q2 by the base-emitter voltage Vbe of the transistor Q2. The potential of the emitter terminal of the transistor Q1 is set lower than the emitter potential of the transistor Q2 by the base-emitter voltage Vbe of the transistor Q1. Therefore, the base-emitter voltage Vbe of the transistor Q2 and the base-emitter voltage Vbe of the transistor Q1 are in a relationship that they cancel out each other. The potential of the base terminal of the transistor Q2 and the potential of the emitter terminal of the transistor Q1 are set identical. As a result, as shown in FIG. 8, the function circuit of FIG. 7 has an input/output characteristic having a curve that is centered at 2.5 V (Vcc/2) and is bent in the vicinity of the reference voltage V1 (change point α) and the reference voltage V2 (change point β).

The output signal Vout is given by the following formulae:

When Vs≧V2, $$Vout=\{R1/(R1+R3)\}(V2-Vs)+Vs \quad (4)$$

When Vs≦V1, $$Vout=\{R2/(R1+R2)\}(Vs-V1)+V1 \quad (5)$$

When V1<Vs<V2, $$Vout=Vs \quad (6)$$

because both of the transistors Q1 and Q3 are rendered off, that is, they are in a high-impedance state.

However, the function circuit of FIG. 5 uses the diodes D1 and D2. In general, diodes have a characteristic that the forward voltage Vd tends to vary with temperature. As seen from Formulae (1) and (2), the formula representing the output signal Vout includes the forward voltage Vd. Therefore, errors indicated by hatching in FIG. 6 occur in the ranges of Vs≧V1+Vd and Vs≦V2−Vd because the diode forward voltage Vd varies being affected by a temperature variation.

Further, since the voltages of the change points are shifted from the respective reference voltages V1 and V2 by the diode forward voltage Vd, designing should take the forward voltage Vd into consideration and hence is complicated.

On the other hand, in the other function circuit of FIG. 7, in general, since a base current Ib2 flowing through the transistor Q2 and a base current Ib1 flowing through the transistor Q1 are different from each other in magnitude, the base-emitter voltage Vbe2 of the transistor Q2 and the base-emitter voltage Vbe1 of the transistor Q1 may be different from each other in magnitude; a relationship Vbe1−Vbe2=0 does not necessarily hold. That is, the two base-emitter voltages Vbe may not cancel out each other sufficiently. As a result, as hatched in FIG. 8, influences of variations in the transistor base-emitter voltages Vbe due to a temperature variation tend to arise in the ranges of Vs≦V1 and Vs≧V2 though in a lower degree than in the function circuit of FIG. 5.

SUMMARY OF THE INVENTION

The present invention has been made to solve the above problems, and an object of the invention is therefore to provide a function circuit that is less prone to be affected by temperature.

The invention provides a function circuit for converting an input signal by a prescribed function, comprising a first transistor; a second transistor; voltage dividing means connected to the first transistor, for dividing the input signal with a prescribed division ratio; a reference voltage source for applying a prescribed reference voltage to a base terminal of the second transistor; and a current mirror circuit that is connected to the first transistor and the second transistor so that the same constant current flows between a collector terminal and an emitter terminal of the first transistor and between those of the second transistor.

For example, a first function circuit is such that the first transistor is a pnp transistor and the second transistor is an npn transistor.

A second function circuit is such that the first transistor is an npn transistor and the second transistor is a pnp transistor.

A function circuit may be formed by using at least one pair of the first function circuit and the second function circuit, at least one first function circuit, or at least one second function circuit.

According to the invention, the use of the current mirror circuit makes it possible to allow the same base current to flow through the paired npn transistor and pnp transistor. Therefore, their base-emitter voltages Vbe can be made identical and can cancel out each other sufficiently even with a temperature variation. As a result, the function circuit is not affected by temperature.

DESCRIPTION OF THE PREFERRED EMBODIMENTS

The present invention will be hereinafter described with reference to the drawings.

Figure 1:
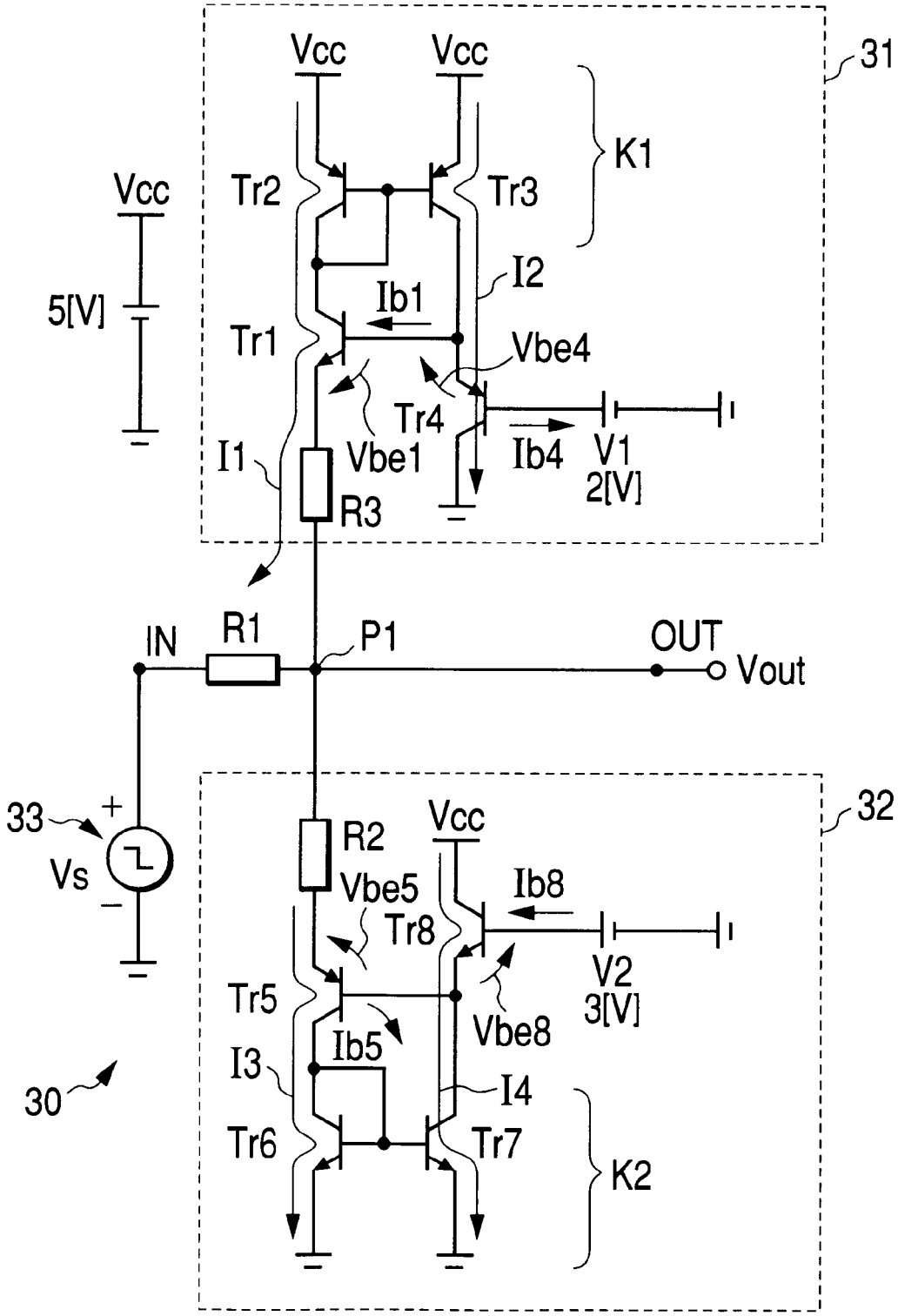
FIG. 1 is a circuit diagram of a function circuit according to the invention.
Figure 2:
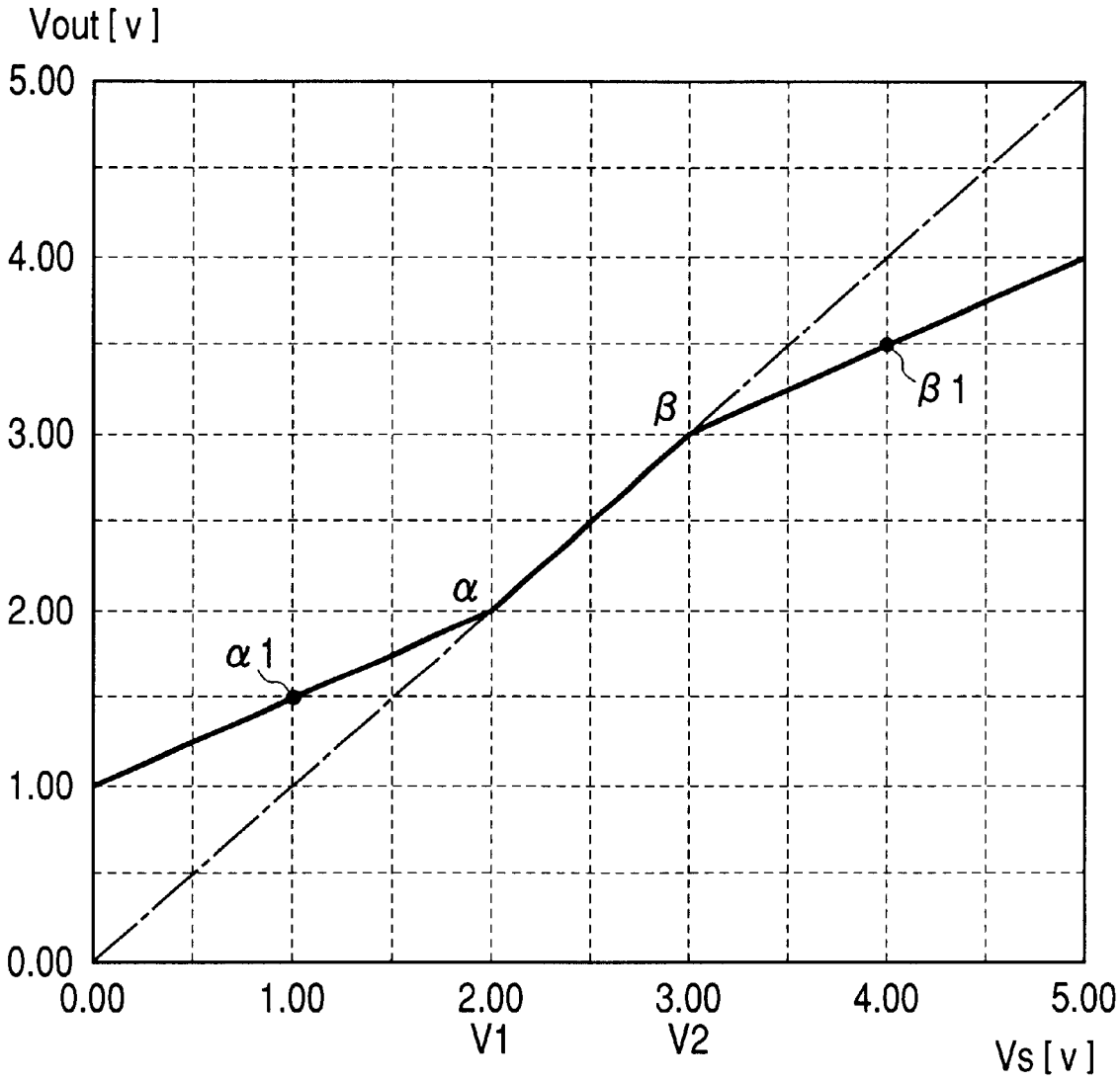
FIG. 2 shows an input/output characteristic of the function circuit of FIG. 1.

FIG. 1 is a circuit diagram of a function circuit 30 according to the invention. FIG. 2 shows an input/output characteristic of the function circuit of FIG. 1.

The function circuit 30 of FIG. 1 is mainly composed of a first circuit 31 and a second circuit 32.

The first circuit 31 is composed of transistors Tr2 and Tr3 that constitute a current mirror circuit K1, an npn transistor Tr1 that is provided on the input side of the current mirror circuit K1, a pnp transistor Tr4 that is provided on the output side of the current mirror circuit K1 and serves as an active load, a resistor R3 that is connected to the emitter terminal of the transistor Tr1, and a reference supply voltage V1 that is applied to the base terminal of the transistor Tr4.

On the other hand, the second circuit 32 is composed of transistors Tr6 and Tr7 that constitute a current mirror circuit K2, a pnp transistor Tr5 that is provided on the input side of the current mirror circuit K2, an npn transistor Tr8 that is provided on the output side of the current mirror circuit K2 and serves as an active load, a resistor R2 that is connected to the emitter terminal of the transistor Tr5, and a reference supply voltage V2 that is applied to the base terminal of the transistor Tr8.

The resistor R3 of the first circuit 31 and the resistor R2 of the second circuit 32 are connected to each other, and an input signal Vs is applied to the connecting point P1 of the resistors R2 and R3 via a resistor R1.

The operation of the function circuit 30 will be described below. More specifically, an exemplary operation of the function circuit 30 will be described with an assumption that the supply voltage Vcc is set at 5 V and the change point reference voltages V1 and V2 are set at 2 V and 3 V, respectively.

(1) Vs≦V1

Since the reference voltage V1=2 V is always applied to the base terminal of the transistor Tr4, the potential of the emitter terminal of the transistor Tr4 and the potential of the base terminal of the transistor Tr1 are set higher than the reference voltage V1 by the base-emitter voltage Vbe4 of the transistor Tr4. The potential of the emitter terminal of the transistor Tr1 is set lower than the base potential of the transistor Tr1 by the base-emitter voltage Vbe1 of the transistor Tr1. Therefore, the emitter potential of the transistor Tr1 is approximately equal to the base potential of the transistor Tr4.

If 1 V is input as an input signal Vs, an emitter current flows through the transistor Tr1 via the resistors R3 and R1 and hence a similar constant current I1 flows through the input side of the current mirror circuit K1. According to a characteristic of the current mirror circuit K1, if the constant current I1 flows through the input side, a constant current I2 that is the same in magnitude as the constant current I1 flows through the output side, that is, through the transistors Tr3 and Tr4 (I1=I2). Since I1=I2, a base current Ib4 of the transistor Tr4 and a base current Ib1 of the transistor Tr1 are set identical (Ib1=Ib4). Therefore, the base-emitter voltage Vbe4 of the transistor Tr4 and the base-emitter voltage Vbe1 of the transistor Tr1 can be set identical (Vbe1=Vbe4). Since the base-emitter voltage Vbe1 of the transistor Tr1 can sufficiently cancel out the base-emitter voltage Vbe4 of the transistor Tr4, the potential of the emitter terminal of the transistor Tr1 can be made equal to the base potential of the transistor Tr4.

Even if a temperature variation has occurred, a variation in the base current Ib4 of the transistor Tr4 and a variation in the base current Ib1 of the transistor Tr1 can be made approximately equal to each other and hence the relationship Vbe4=Vbe1 can be maintained. Since Vbe1 and Vbe4 can cancel out each other sufficiently without being affected by temperature, the emitter potential of the transistor Tr1 can always be made equal to the base potential of the transistor Tr4.

The output signal Vout of this function circuit 30 is given by the following Formula (7):

When Vs≦V1, $$Vout=\{R1/(R1+R3)\}(V1-Vs)+Vs \quad (7)$$

For example, if R1=R3, Vs=1 V, and V1=2 V, the output voltage Vout of the function circuit 30 becomes equal to 1.5 V as indicated by point α1 in the graph of FIG. 2.

In this state, in the second circuit 32, the transistor Tr5 is off, that is, in a high-impedance state. Therefore, the second, circuit 32 does not cause any influences on the output signal Vout of the function circuit 30.

(2) Vs≧V2

As shown in FIG. 1, the transistors Tr5 and Tr8 of the second circuit 32 are a pnp transistor and an npn transistor, respectively.

Since the reference supply voltage V2=3 V is always applied to the base terminal of the transistor Tr8, the transistor Tr8 is always on. Therefore, the potential of the emitter terminal of the transistor Tr8 and the potential of the base terminal of the transistor Tr5 are set lower than the base potential of the transistor Tr8 by the base-emitter voltage Vbe8 of the transistor Tr8. The potential of the emitter terminal of the transistor Tr5 is set higher than the base potential of the transistor Tr5 by the base-emitter voltage Vbe5 pof the transistor Tr5. Therefore, the emitter potential of the transistor Tr5 is set approximately equal to the base potential (3 V) of the transistor Tr8.

If an input signal Vs (≧V2) is applied, a current 13 flows through the collector terminal of the transistor Tr5 via the resistors R1 and R2 and hence a similar current 13 flows through the input side of the current mirror circuit K2. Therefore, a constant current 14 that is the same in magnitude as the constant current 13 flows through the output side of the current mirror circuit K2, that is, through the transistors Tr8 and Tr7 (I3=I4) Since I3=I4, a base current Ib8 of the transistor Tr8 and a base current Ib5 of the transistor Tr5 are set identical (Ib8=Ib5). Therefore, the base-emitter voltage Vbe5 of the transistor Tr5 and the base-emitter voltage Vbe8 of the transistor Tr8 can be set identical (Vbe5=Vbe8). Since the base-emitter voltage Vbe8 of the npn transistor Tr8 can sufficiently cancel out the base-emitter voltage Vbe5 of the pnp transistor Tr5, the potential of the emitter terminal of the transistor Tr5 can be made equal to the base potential of the transistor Tr8.

Even if a temperature variation has occurred, a variation in the base current Ib8 of the transistor Tr8 and a variation in the base current Ib5 of the transistor Tr5 can be made approximately equal to each other and hence the relationship Vbe8=Vbe5 can be maintained. Since Vbe8 and Vbe5 can cancel out each other sufficiently without being affected by temperature, the emitter potential of the transistor Tr5 can always be made equal to the base potential of the transistor Tr8.

The output signal Vout of this function circuit 30 is given by the following Formula (8):

When Vs≧V2, $$Vout=\{R2/(R1+R2)\}(Vs-V2)+V2 \quad (8)$$

For example, if R1=R2, Vs=4 V, and V2=3 V, the output voltage Vout of the function circuit 30 becomes equal to 3.5 V as indicated by point β1 in the graph of FIG. 2.

In this state, in the first circuit 31, the transistor Tr1 is off, that is, in a high-impedance state. Therefore, the first circuit 31 does not cause any influences on the output signal Vout of the function circuit 30.

(3) V1<Vs<V2

In this case, both of the transistor Tr1 of the first circuit 31 and the transistor Tr5 of the second circuit 32 are set off, that is, rendered in a high-impedance state, and hence the input signal Vs becomes the output signal Vout of the function circuit 30 as it is (Vout=Vs).

In the function circuit 30, an input signal Vs that is in the range between the reference voltages V1 and V2 can be output as it is (Vout=Vs). By setting the reference voltages V1 and V2, in the ranges of Vs≦V1 and Vs≧V2, output signals Vout that satisfy Formulae (7) and (8) can be generated.

Further, in the ranges of Vs≦V1 and Vs≧V2, the slopes of the straight lines of Formulae (7) and (8) can easily be set in accordance with the ratio among the resistances R1, R2, and R3.

Since the transistor base-emitter voltages Vbe can cancel out each other sufficiently, no influences are caused by variations in the diode forward voltages Vd or the transistor base-emitter voltages Vbe due to a temperature variation.

Figure 3:
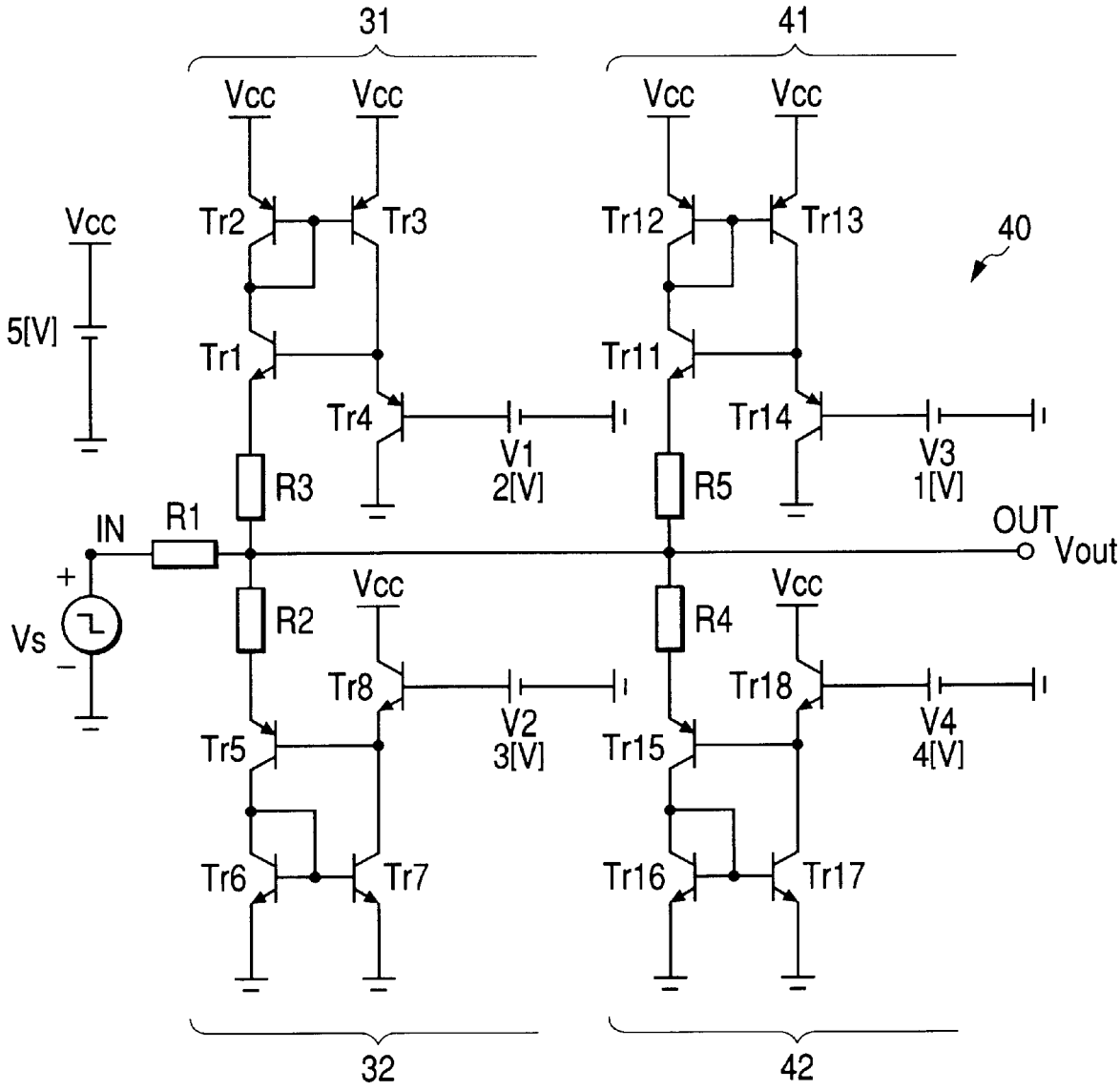
FIG. 3 is a circuit diagram of a combination of function circuits shown in FIG. 1.
Figure 4:
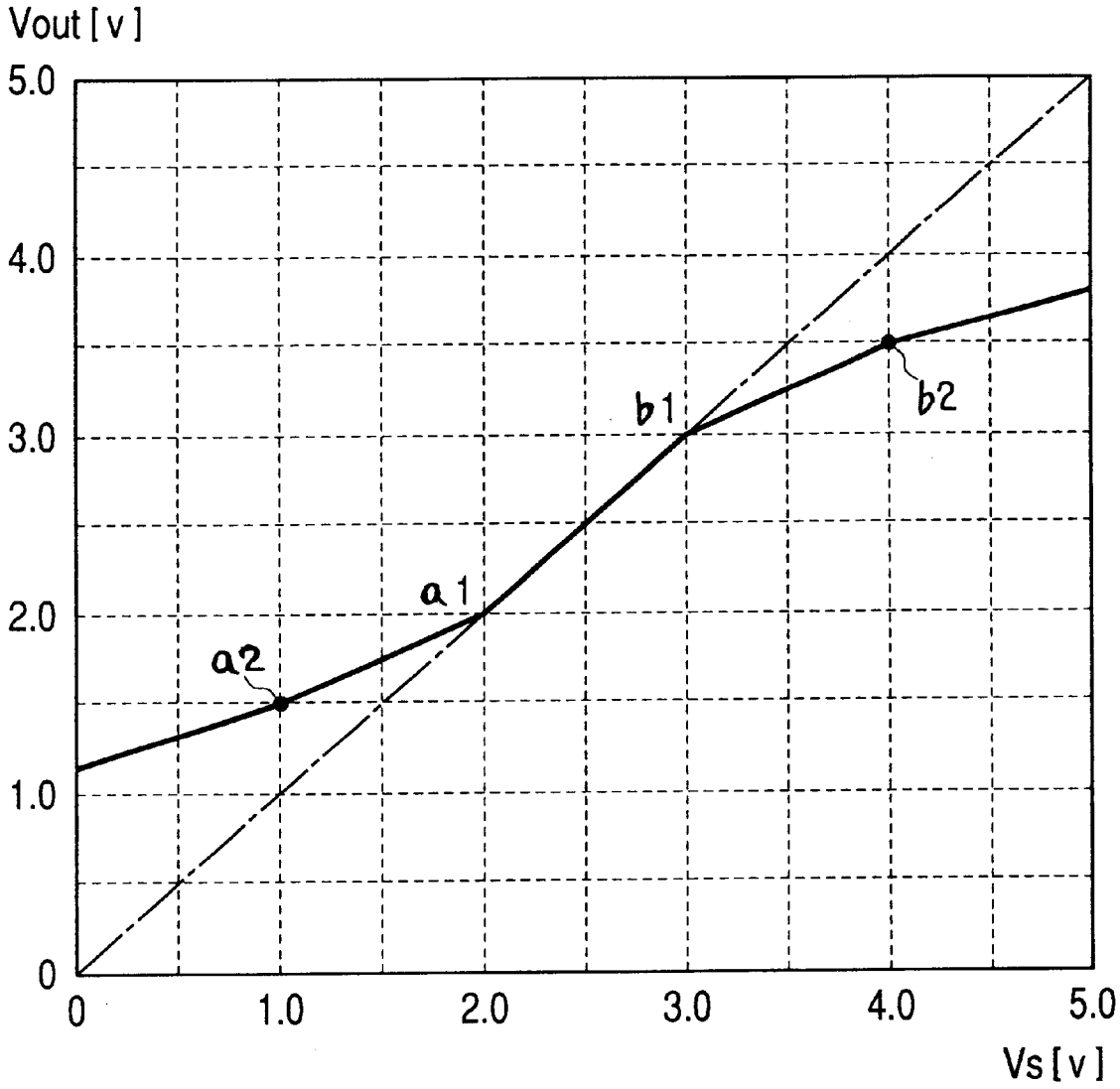
FIG. 4 shows an input/output characteristic of the function circuit of FIG. 3.
Figure 5:
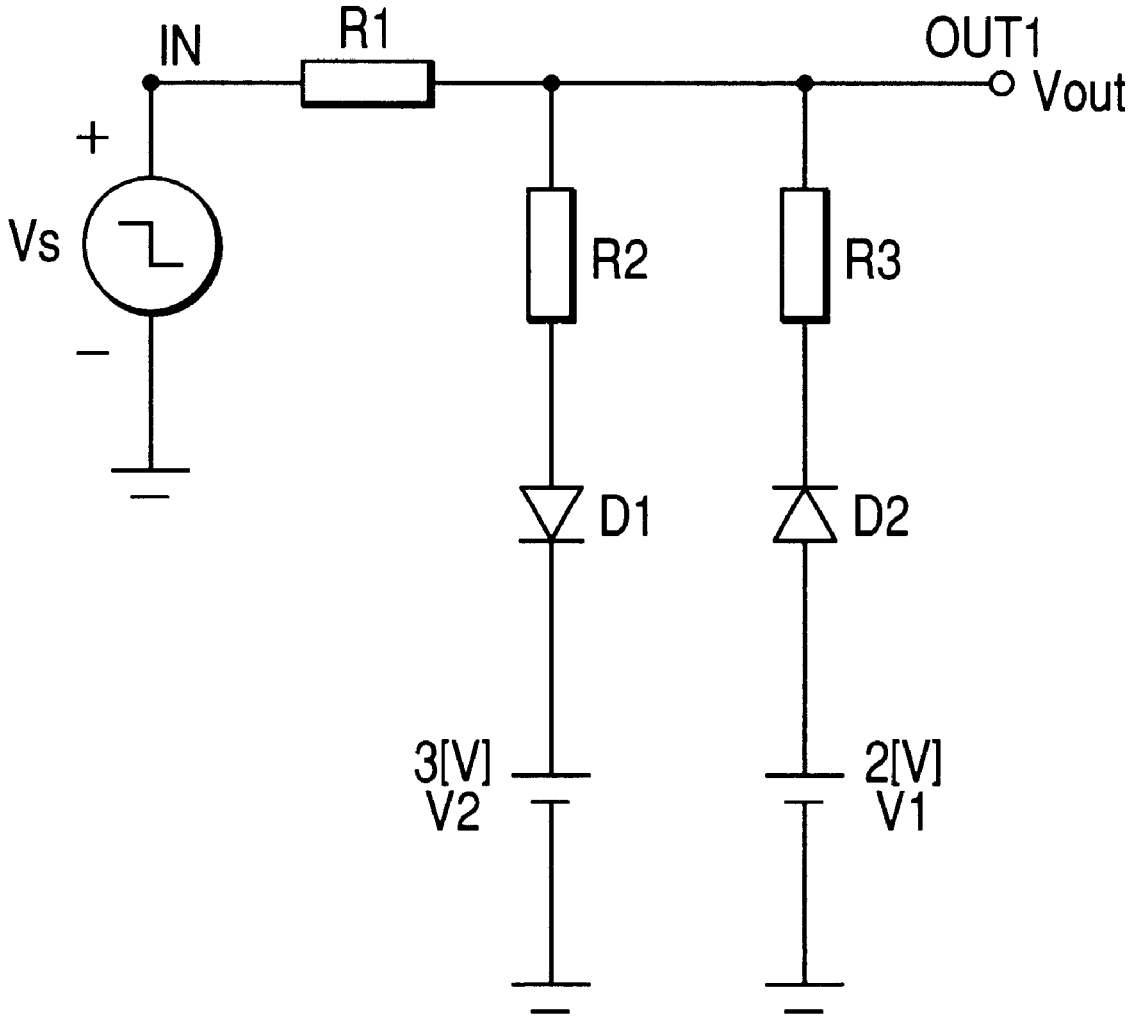
FIG. 5 PRIOR ART
FIG. 5 is a circuit diagram of a conventional function circuit.
Figure 6:
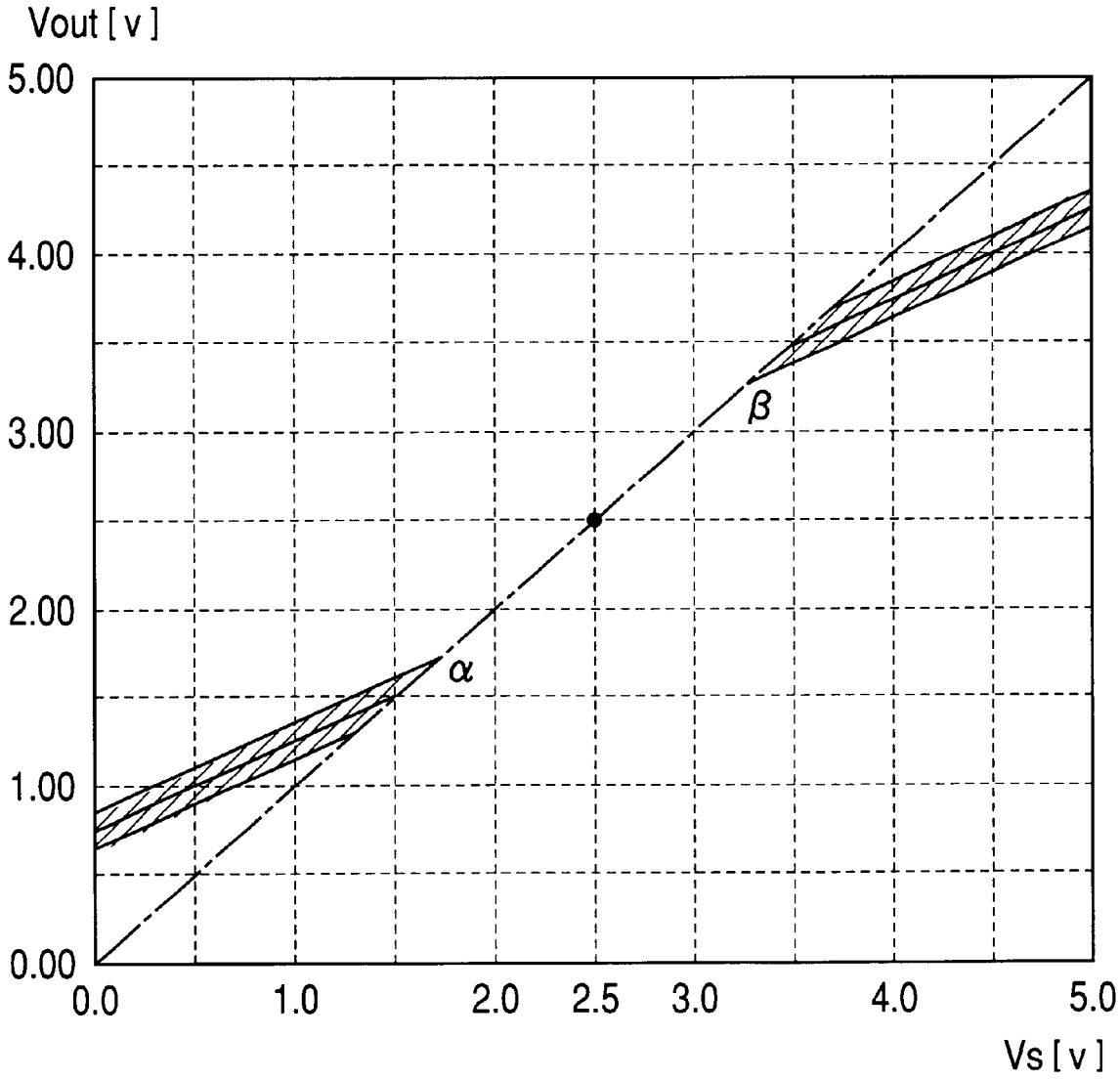
FIG. 6 PRIOR ART
FIG. 6 shows an input/output characteristic of the circuit of FIG. 5.
Figure 7:
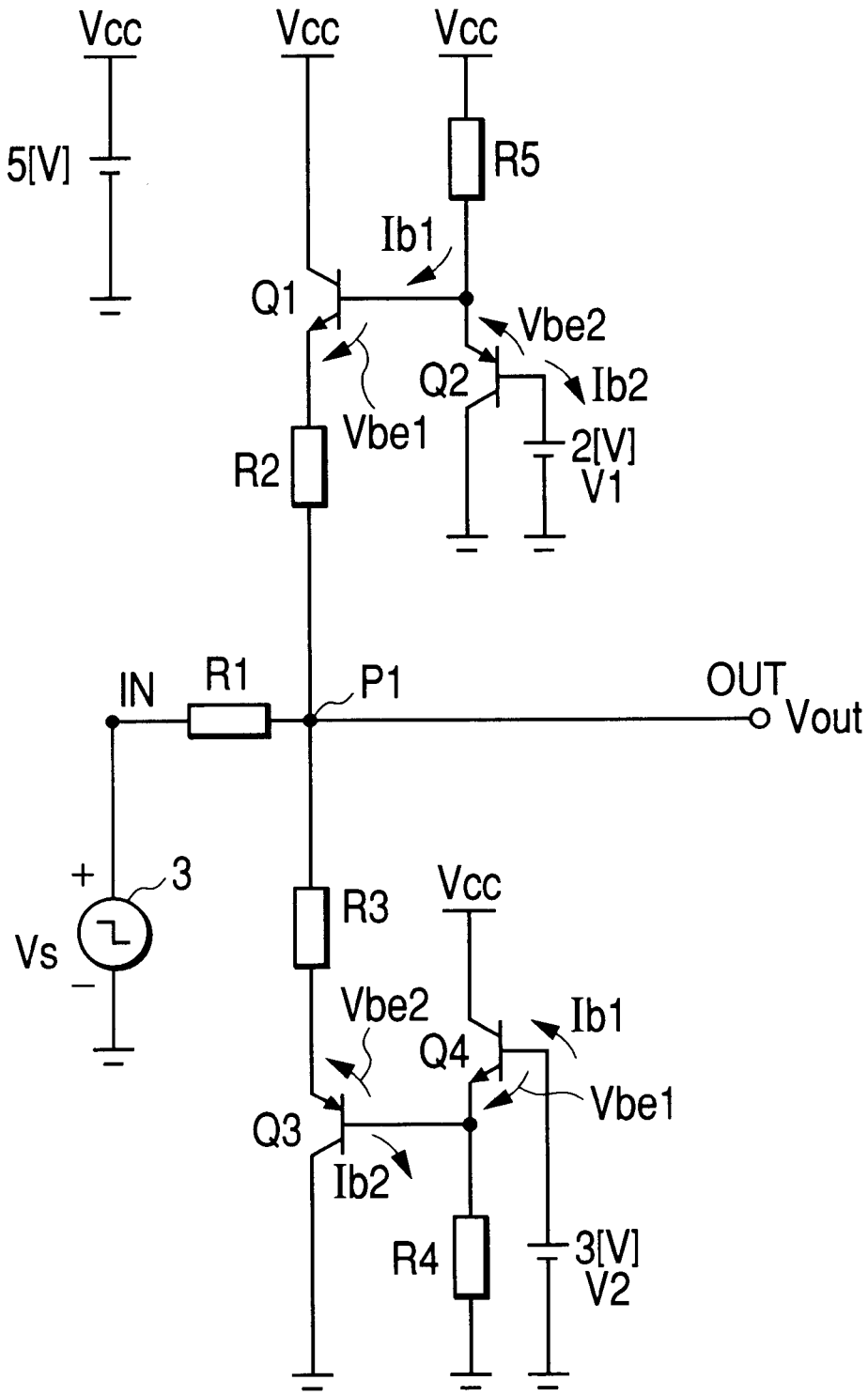
FIG. 7 PRIOR ART
FIG. 7 is a circuit diagram of another conventional function circuit.
Figure 8:
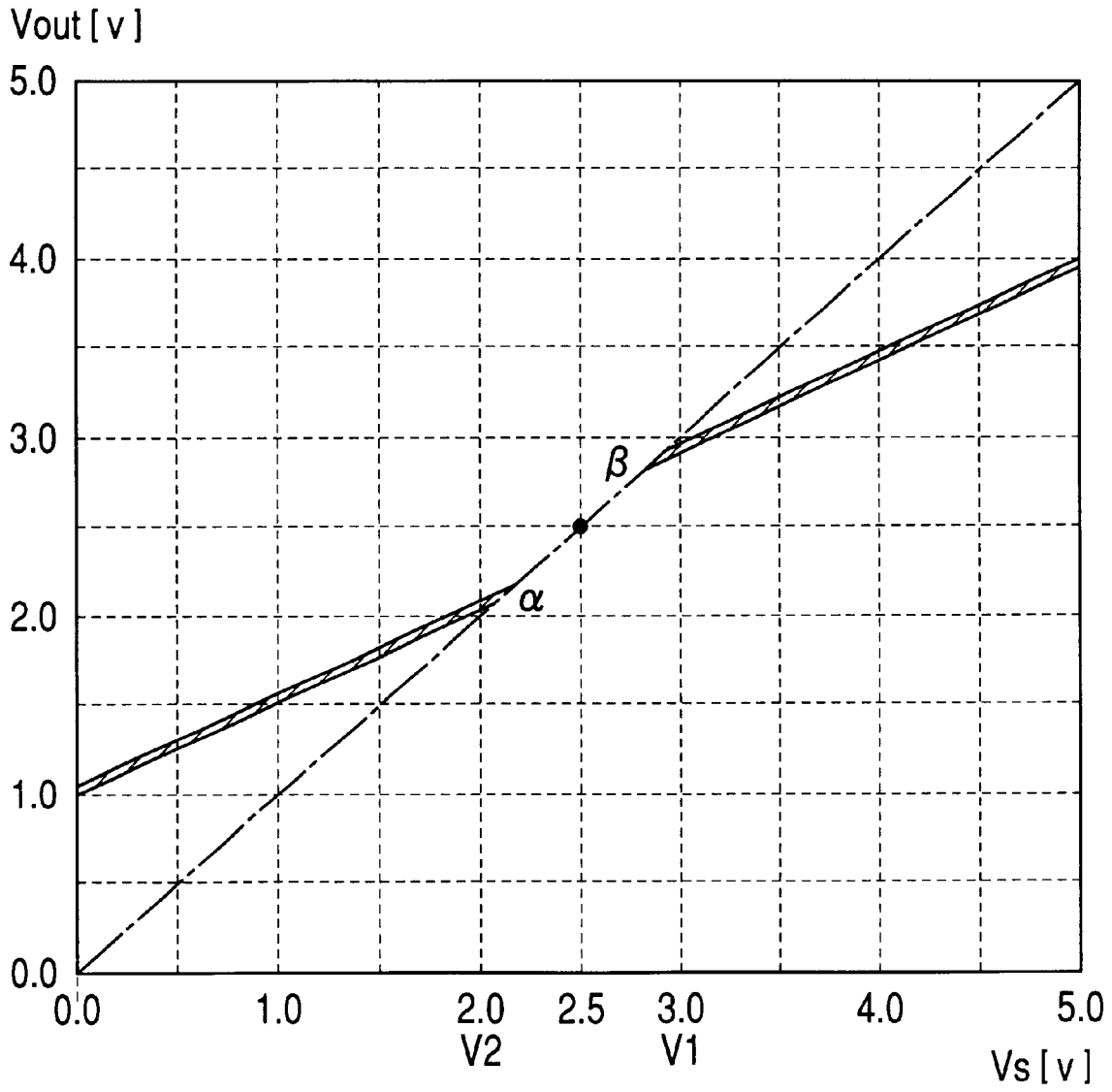
FIG. 8 PRIOR ART
FIG. 8 shows an input/output characteristic of the function circuit of FIG. 7.

FIG. 3 is a circuit diagram of a function circuit 40 that is a combination of function circuits shown in FIG. 1. FIG. 4 is an input/output characteristic of the function circuit 40 of FIG. 3.

The function circuit 40 of FIG. 3 is such that two circuits each being the main circuit of the function circuit 30 shown in FIG. 1, except for the voltage source circuit, are connected to each other. More specifically, a third circuit 41 that is the same as the first circuit 31 and a fourth circuit 42 that is the same as the second circuit 32 are connected to the function circuit 30. However, reference voltages V3 and V4 of the third circuit 41 and the fourth circuit 42 are different from the reference voltages V1 and V2 of the first circuit 31 and the second circuit 32, respectively. For example, the reference voltages V3 and V4 are set at 1 V and 4 V, respectively.

The resistance division ratios R2/(R1+R2) and R1/(R1+R3) are set at prescribed values.

As shown in FIG. 4, in this function circuit 40, change points a2 and b2 can be set at Vs=1 V and Vs=4 V in addition to the change points a1 and b1 that are located at Vs=2 V and Vs=3 V, respectively. This makes it possible to obtain a desired function.

The number of change points can be increased by combining a plurality of circuits each being the main part of the function circuit 30 of FIG. 1 in the above-described manner. An arbitrary function circuit can be obtained by connecting linear functions at those change points.

Although the above function circuits employ the first circuit and the second circuit in the form of a pair, the invention is not limited to such a case. Only a plurality of first circuits or only a plurality of second circuits may be combined together. Even in the case of combining first circuits and second circuits, the first circuits and the second circuits need not be used in the same number. Desired function circuits can be formed by combining first circuits and second circuits in various manners.

As described above, according to the invention, an input signal can be converted into an output signal by a desired function circuit without being affected by temperature.

What is claimed is:

1. A function circuit for converting an input signal by a prescribed function, comprising:

a first transistor;

a second transistor;

voltage dividing means connected to the first transistor, for dividing the input signal with a prescribed division ratio;

a reference voltage source for applying a prescribed reference voltage to a base terminal of the second transistor; and a current mirror circuit that is connected to the first transistor and the second transistor so that the same constant current flows between a collector terminal and an emitter terminal of the first transistor and between those of the second transistor, wherein the first transistor is a pnp transistor and the second transistor is an npn transistor.

2. A function circuit for converting an input signal by a prescribed function, comprising:

a first transistor;

a second transistor;

voltage dividing means connected to the first transistor, for dividing the input signal with a prescribed division ratio;

a reference voltage source for applying a prescribed reference voltage to a base terminal of the second transistor; and a current mirror circuit that is connected to the first transistor and the second transistor so that the same constant current flows between a collector terminal and an emitter terminal of the first transistor and between those of the second transistor, wherein the first transistor is an npn transistor and the second transistor is a pnp transistor.

3. A function circuit for converting an input signal by a prescribed function, including at least one pair of a first function circuit and a second function circuit each comprising:

a first transistor;

a second transistor;

voltage dividing means connected to the first transistor, for dividing the input signal with a prescribed division ratio;

a reference voltage source for applying a prescribed reference voltage to a base terminal of the second transistor; and a current mirror circuit that is connected to the first transistor and the second transistor so that the same constant current flows between a collector terminal and an emitter terminal of the first transistor and between those of the second transistor, wherein the first transistor of the first function circuit is a pnp transistor, the second transistor of the first function circuit is an npn transistor, the first transistor of the second function circuit is an npn transistor and the second transistor of the second function circuit is a pnp transistor.

* * * * *